United States Patent [19]

Johnson et al.

[11] 4,016,820

[45] Apr. 12, 1977

[54] CLOSURE ASSEMBLY FOR A FURNACE

[75] Inventors: Richard C. Johnson; Kenneth E. Lee, both of Dansville, N.Y.

[73] Assignee: Foster Wheeler Energy Corporation, Livingston, N.J.

[22] Filed: Nov. 17, 1975

[21] Appl. No.: 632,891

[52] U.S. Cl. ..... 110/173 R; 202/242

[51] Int. Cl.[2] ..... F23M 7/00

[58] Field of Search ..... 110/173 R; 106/65; 202/242, 248, 267 R

[56] References Cited

UNITED STATES PATENTS

| | | | |
|---|---|---|---|
| 3,162,584 | 12/1961 | Cremer et al. | 110/173 X |
| 3,505,174 | 4/1970 | Peterson et al. | 110/173 X |
| 3,629,094 | 12/1971 | Silverblatt | 110/173 |
| 3,935,060 | 1/1976 | Blome et al. | 106/65 |

OTHER PUBLICATIONS

Harbison-Walker, Modern Refractory Practice, 4th Edition, of 1961, pp. 130, 166 and 167.

*Primary Examiner*—Kenneth W. Sprague
*Attorney, Agent, or Firm*—Marvin A. Naigur; John E. Wilson

[57] ABSTRACT

A closure assembly for a furnace wall in which a plug member is secured to a shell member which, in turn, is pivotally mounted to the furnace wall. The plug member is formed from a cast ceramic fiber tamping mix of bulk fiber and high temperature inorganic binders and has a relatively low density. A centrally located stepped bore extends through the plug member for receiving a rod to the interior face of the shell member. A fastening means engages the rod for securing the plug member relative to the shell member and an insert formed from the same material as the plug member is fixed in the bore hole.

8 Claims, 4 Drawing Figures

FIG. 3.
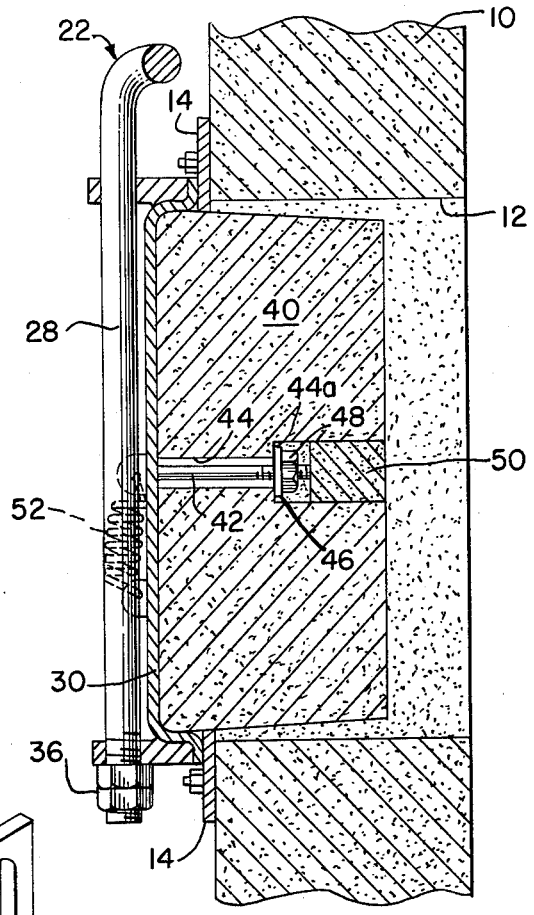
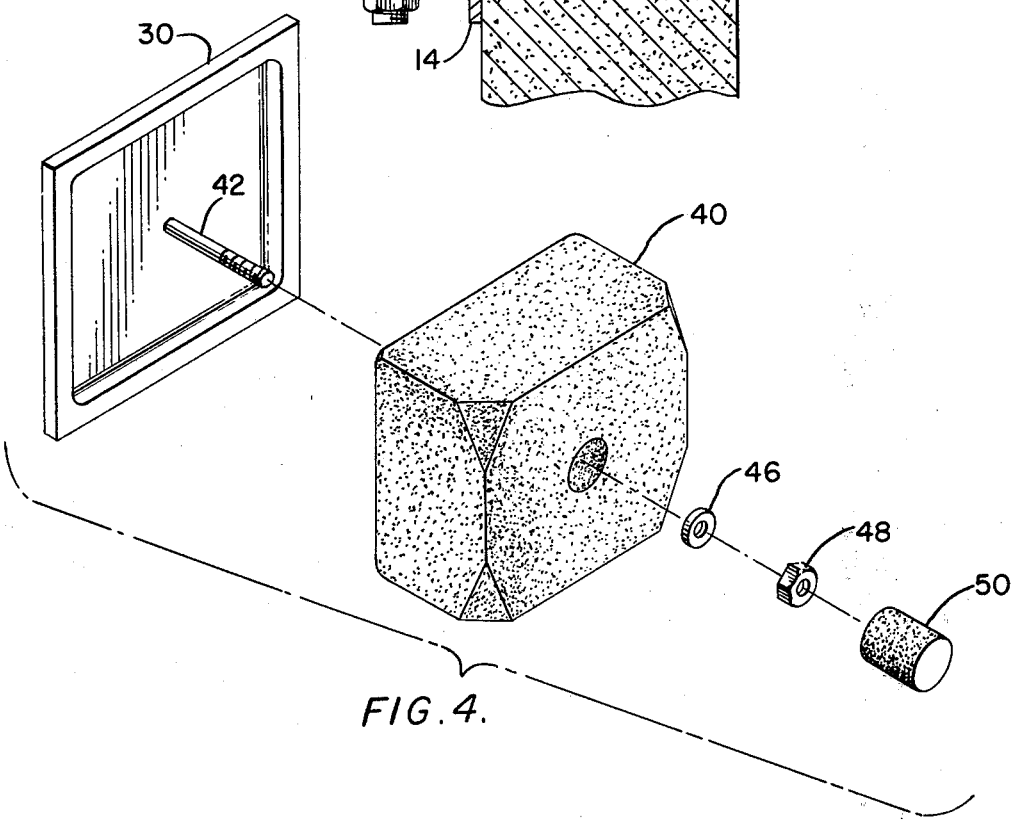
FIG. 4.

CLOSURE ASSEMBLY FOR A FURNACE

BACKGROUND OF THE INVENTION

Insulated access doors for furnace walls are typically fabricated from concrete troweled over a wire screen reinforcement attached to the door structure, or from a plurality of heavy fire bricks attached by complex lug arrangements to the door structure. Both of these arrangements are expensive and their installation is time consuming since the resulting assembly may weigh well over a hundred pounds any may require the services of at least two mechanics over a period of days to complete the final installation. Also, the doors presently in use are somewhat brittle and are damaged quite easily if not handled with extreme care, thus adding to the difficulties.

Still another problem associated with these type doors is that they often require the installation of an additional fire brick protective shield at the face of the door to accommodate excess temperatures encountered in the furnace which would oxidize the retaining metal screen reinforcement. Of course, the installation and materials cost involved in such type of shields further adds to the expense involved.

SUMMARY OF THE INVENTION

It is, therefore, an object of the present invention to provide a closure assembly for a furnace which can be fabricated, installed, and repaired in a relatively simple and fast manner and at a relatively low cost.

It is a further object of the present invention to provided a closure assembly of the above type which is sturdy, resilient, a lightweight.

It is a still further object of the present invention to provide a closure assembly of the above type which eliminates the need for the above-mentioned fire brick protective shield.

Toward the fulfillment of these and other objects, the closure assembly of the present invention comprises a shell member, a plug member of a ceramic material engaging the inner wall of the shell member, and securing means for securing the plug member to the shell member.

BRIEF DESCRIPTION OF THE DRAWINGS

The above brief description, as well as further objects, features and advantages of the present invention will be more fully appreciated by reference to the following detailed description of a presently preferred but nonetheless illustrative embodiment in accordance with the present invention when taken in connection with the accompanying drawings wherein:

FIG. 3 is an enlarged, vertical, cross-sectional view taken along the line 3—3 of FIG. 2; and FIG. 4 is an exploded view of the closure assembly of the present invention.

DESCRIPTION OF THE PREFERRED EMBODIMENTS

Figure 1:
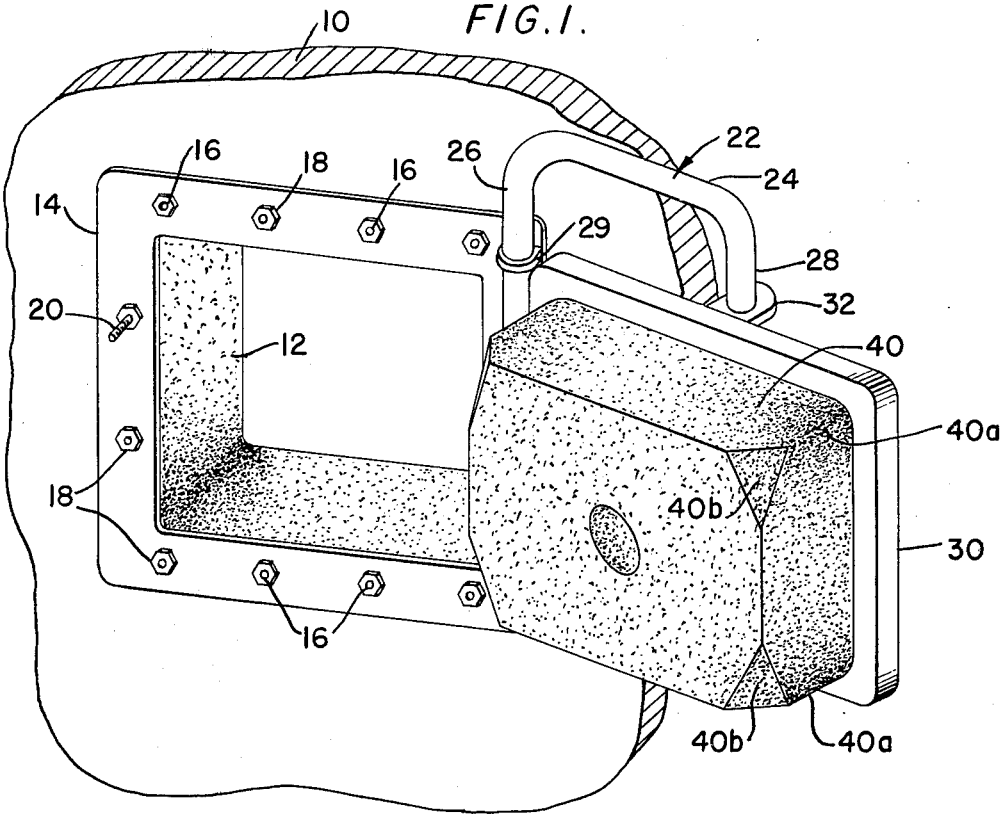
FIG. 1 is a front elevational view depicting the closure assembly of the present invention shown in an open position relative to the access opening of a furnace wall.
Figure 2:
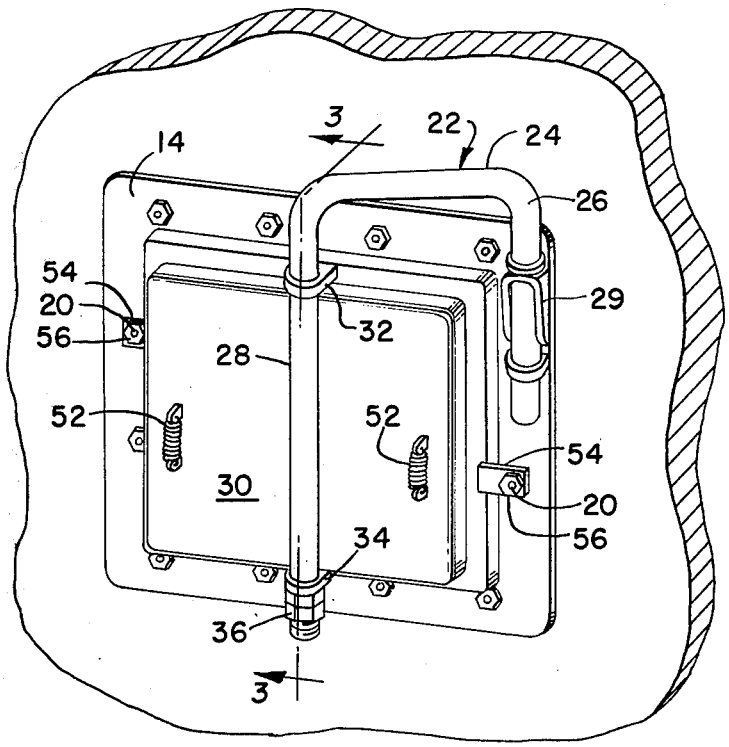
FIG. 2 is a view similar to FIG. 1 but depicting the closure assembly in a closed position.

Referring specifically to FIGS. 1 and 2, the reference numeral 10 refers in general to the front wall of a furnace enclosure which is formed with an access opening 12. Although not clear from the drawings, it is understood that the wall 10 can be formed in any known manner and can include water tubes, a refractory material, and other components normally utilized in conventional walls of this type.

A rectangular faceplate 14 is attached to the outer surface of the furnace wall 10 and surrounds the access opening 12, with the faceplate 14 defining an opening which substantially corresponds in size to the opening 12. The faceplate 14 is fastened relative to the wall 10 by a plurality of bolts 16 which extend through the wall and the faceplate and which receive a plurality of nuts 18. Two additional bolts 20 (FIGS. 1 and 2) are provided which are disposed in the same manner as the bolts 16 but which extend a predetermined extended length beyond the outer face of their corresponding nuts 18, for reasons to be described in detail later.

A davit hinge assembly is provided which includes a bar 22 bent in two planes to form a base portion 24, a relatively short leg portion 26, and a relatively long leg portion 28. The relatively short leg portion 26 is rotatably mounted in a bracket 29 affixed to one side of the faceplate 14 to permit pivotal movement of the bar 22 relative to the faceplate.

A shell member 30 is provided which has a pair of brackets 32 and 34 secured to its rear face for receiving the relatively long leg portion 28 of the bar 20, to permit pivotal movement of the shell member relative to the bar. The free end portion of the leg portion 28 is threaded and accommodates a nut assembly 36 for maintaining the shell member 30 on the leg portion 28.

A plug member 40 is secured to the inner face of the shell member 30. The plug member 40 is preferably formed of a ceramic material of a type to be described in detail later and is formed in a generally rectangular shape with rounded, tapered edges 40*a* terminating in truncated corners 40*b*, as shown in FIG. 1.

The plug member 40 is attached relative to the shell member 30 in a manner better shown in FIGS. 3 and 4. In particular, a portion of the plug member 40 extends within the shell member 30 with the leading face of the plug member engaging the inner wall of the shell member. A rod 42 has one end attached to the center of the inner face of the shell member 30 in any known manner. The rod 42 extends through a stepped bore 44 formed through the plug member 40 and defining a shoulder 44*a* between the larger diameter bore portion and the smaller diameter bore portion.

A washer 46 rests against the shoulder 44*a* and extends over the rod 42. The free end of the rod 42 is threaded and terminates in the larger diameter portion of the bore 44 and a nut 48 engages the threaded rod portion and abuts against the washer 46 to secure the plug member 40 relative to the shell member 30. An insert 50 of the same material as the plug member 40 extends in that portion of the bore 44 not occupied by the rod 42. It is noted that, in the closed position shown in FIG. 3, a portion of the plug member 40 extends out from the shell member 30 and into the access opening 12.

Referring again to FIG. 2, a pair of spring type handles 52 are provided on the outer face of the shell member 30 to facilitate the opening and closing of the shell member relative to the access opening 12. As also shown in FIG. 2, a pair of tabs 54 extend over the bolts 20, and an additional nut 56 threadedly engages each of the latter bolts to secure the tabs in the position shown in which a portion of each tab extends over the shell member 30 to secure it over the access opening 12.

As a result of the davit hinge assembly, the shell member 30 can be moved to an open position and then be pivoted relative to the leg portion 28 in either direction to facilitate the opening of the closure assembly.

The plug member 40 is preferably constructed of a cast block formed from a tamping mix of bulk fibers and high temperature inorganic binders. The particular material most preferred because of its lightweight properties and high temperature insulating capabilities is manufactured by the Carborundum Company and has a product designation of FC-25. In this configuration, the plug member would have a density of approximately 20–25 pounds per cubic foot which, of course, renders the closure assembly of the present invention extremely light when compared to the prior art assemblies discussed above. The shell member 30 can be fabricated of cast iron or forged steel in a conventional manner, in which case the rod 42 would be welded flush against the inner face of the shell member.

Several advantages result from the arrangement of the present invention. For example, the plug member 40 is relatively light in weight and therefore can be easily handled during installation, repair or replacement. Of course, the plug member 40 is easily removed and installed relative to the shell member 30 and due to its light weight can be installed or removed by only one mechanic, thereby minimizing labor costs. Also, the particular material used to fabricate the plug member 40 is capable of establishing an acceptable temperature differential of over 2000° F. without the necessity of installing an additional fire brick protective shield or the like at the outer face of the access opening 12. Also, the depth of the plug member from its front face to its rear face may be as little as 6 inches and yet still accomplish this high temperature insulation.

Of course, variations of the specific construction and arrangement of the assembly disclosed above can be made by those skilled in the art without departing from the invention as defined in the appended claims.

What is claimed is:

1. A closure assembly for an access opening in a furnace wall, said assembly comprising:

a shell member;

a plug member having a portion extending in said shell member and a portion adapted to extend in said access opening;

a stepped bore extending through said plug member and defining a shoulder between its ends;

a rod affixed at one end to the inner wall of said shell member and extending within said bore;

a nut threadedly engaging said rod within said bore and bearing against said shoulder to secure said plug member to said shell member;

an insert positioned in that portion of said bore not occupied by said rod, said insert being of the same material as said plug member; and mounting means for pivotably mounting said shell member to said furnace wall for movement between a closed and open positions relative to said access opening.

2. The assembly of claim 1 wherein said plug member is constructed of a cast block formed from a tamping mix of bulk fibers and high temperature inorganic binders, and the density of said plug member is less than 25 pounds per cubic foot.

3. The assembly of claim 1 wherein said mounting means comprises a support rod having a portion pivotally supported on said furnace wall and another portion pivotally supporting said shell member, such that said shell member is pivotally mounted relative to said furnace wall and is rotably mounted relative to said support rod.

4. The assembly of claim 3 wherein the leading face of said plug member engages the inner wall of said shell member.

5. A closure assembly for an access opening in a furnace wall, said assembly comprising:

a shell member;

a plug member of a ceramic material having a density of less than 25 pounds per cubic foot, a portion of said plug member extending in said shell member and a portion adapted to extend in said access opening;

a bore formed in said plug;

a rod affixed at one end to the inside wall of said shell member, the other end of said rod extending within said bore;

a nut threadedly engaging said rod within said bore to attach said plug member to said shell member;

an insert within that portion of said bore not occupied by said rod, said insert being of the same material as said plug member; and mounting means for pivotally mounting said shell member to said furnace wall for movement between a closed and open positions relative to said access opening.

6. The assembly of claim 5 wherein said mounting means comprises a support rod having a portion pivotally mounted on said furnace wall and another portion pivotally supporting said shell member, such that said shell member is pivotally mounted relative to said furnace wall and is rotatably mounted relative to said support rod.

7. The assembly of claim 5 wherein said plug member is constructed of a cast block formed from a tamping mix of bulk fibers and high temperature inorganic binders.

8. The assembly of claim 5 wherein the leading face of said plug member engages the inner wall of said shell member.

* * * * *